United States Patent [19]

Schlosser

[11] 4,029,442

[45] June 14, 1977

[54] HIGH PRESSURE PISTON PUMP AND WIPER, SEALING, VALVING STRUCTURE

[75] Inventor: Paul W. Schlosser, Missouri City, Tex.

[73] Assignee: Edward Bleiweiss, Houston, Tex.

[22] Filed: Aug. 19, 1975

[21] Appl. No.: 605,914

[52] U.S. Cl. ..... 417/489; 92/168; 417/403; 417/540; 417/900

[51] Int. Cl.[2] ..... F04B 7/04

[58] Field of Search ..... 417/489, 398, 900, 437, 417/540, 542, 456, 457; 92/87, 162, 165 R, 167, 168

[56] References Cited

UNITED STATES PATENTS

| | | | |
|---|---|---|---|
| 1,043,267 | 11/1912 | Stallsworth | 417/437 |
| 1,819,381 | 8/1931 | Palmer | 417/456 |
| 2,393,096 | 1/1946 | Fitzgerald | 417/900 |
| 2,569,903 | 10/1951 | Santarelli | 222/377 X |
| 2,593,316 | 4/1952 | Kraft | 417/542 |
| 2,951,450 | 9/1960 | Fisher | 417/542 X |
| 3,233,554 | 2/1966 | Huber et al. | 92/168 X |
| 3,802,805 | 4/1974 | Roeser | 417/489 X |

FOREIGN PATENTS OR APPLICATIONS

| | | | |
|---|---|---|---|
| 437,032 | 11/1926 | Germany | 417/900 |

*Primary Examiner*—William L. Freeh
*Assistant Examiner*—Edward Look
*Attorney, Agent, or Firm*—Hill, Gross, Simpson, Van Santen, Steadman, Chiara & Simpson

[57] ABSTRACT

A high pressure piston pump especially suitable for moving heavy high viscosity and abrasive materials, which has its piston in substantial clearance relation in a cylinder, is operable in a pumping stroke to drive into a flexibly deflectable, elastic combination valving, wiping and sealing elastomeric ring which not only maintains tensioned sealing engagement with the piston but also reacts to pump pressure to improve the sealing engagement during pumping stroke of the piston, and permits relaxation of grip on the piston and leakage forwardly along the piston during return stroke suction in front of the piston.

4 Claims, 3 Drawing Figures

30
29
28
27
5
8
51
II
11
40
45
47
44
48
9
7
13
15
14
19
18
10
54
12
31
53
39
49
38
42
43
17
24
22
23
20
21
25
32
37
34
35
33
50
52
55

HIGH PRESSURE PISTON PUMP AND WIPER, SEALING, VALVING STRUCTURE

This invention relates in general to pumps, and is more particularly concerned with a new and improved high pressure piston pump and wiper, sealing and valving structure.

Pumping of heavy, often abrasive materials, such for example, as must be handled in some industrial processes, in the oil fields, in spray coating, moving liquid-carried particulate solids such as vermiculite, and the like, has involved severe problems and drawbacks, not the least of which has been the high incidence of wear of moving pump parts, and particularly piston and cylinder parts and associated valving generally heretofore considered necessary for pump operation.

Another problem with prior pumps, in general, has been the excessive and wasteful power consumption due to drag from close tolerances that were deemed necessary, often involving metal-to-metal contact between relatively moving parts, and frequently heavy seal structures which have imposed power wasting frictional resistances between the sealed parts.

An important object of the present invention is to overcome the disadvantages, deficiencies, inefficiencies, shortcomings and problems encountered with prior high pressure piston pumps and not only to improve substantially the pumping efficiency of such pumps but also to minimize wear in such pumps especially in moving heavy fluent materials even when loaded with abrasive particulate material.

Another object of the invention is to provide a new and improved wiper, sealing, valving structure for high pressure piston pumps.

A further object of the invention is to avoid and at least to minimize power losses due to friction and drag in the pumping of heavy, e.g. high viscosity and/or solids, loaded, fluent materials.

According to features of the present invention, there is provided a pump especially suitable for moving heavy fluent and abrasive materials and comprising means defining a hollow cylinder chamber having an axially extending chamber wall, a piston in the cylinder chamber and having its perimeter in limited spaced gap relation to the chamber wall, means for driving the piston in axial pumping and return strokes, and a combination valving, sealing and wiping flexibly deflectable elastic lip seal ring concentric with and fixedly mounted in the path of stroking movement of the piston and having an annular lip projecting in the direction of the pumping stroke of the piston and slidably engaging about the piston perimeter, the lip being compressible about the piston perimeter to improve the sealing grip of the lip during pumping stroke, and the lip being expansible during return stroke of the piston to relieve grip of the lip on the piston perimeter.

Other objects, features and advantages of the invention will be readily apparent from the following description of a representative embodiment thereof, taken in conjunction with the accompanying drawings although variations and modifications may be effected without departing from the spirit and scope of the novel concepts embodied in the disclosure, and in which.

Figures 1, 2, 3:
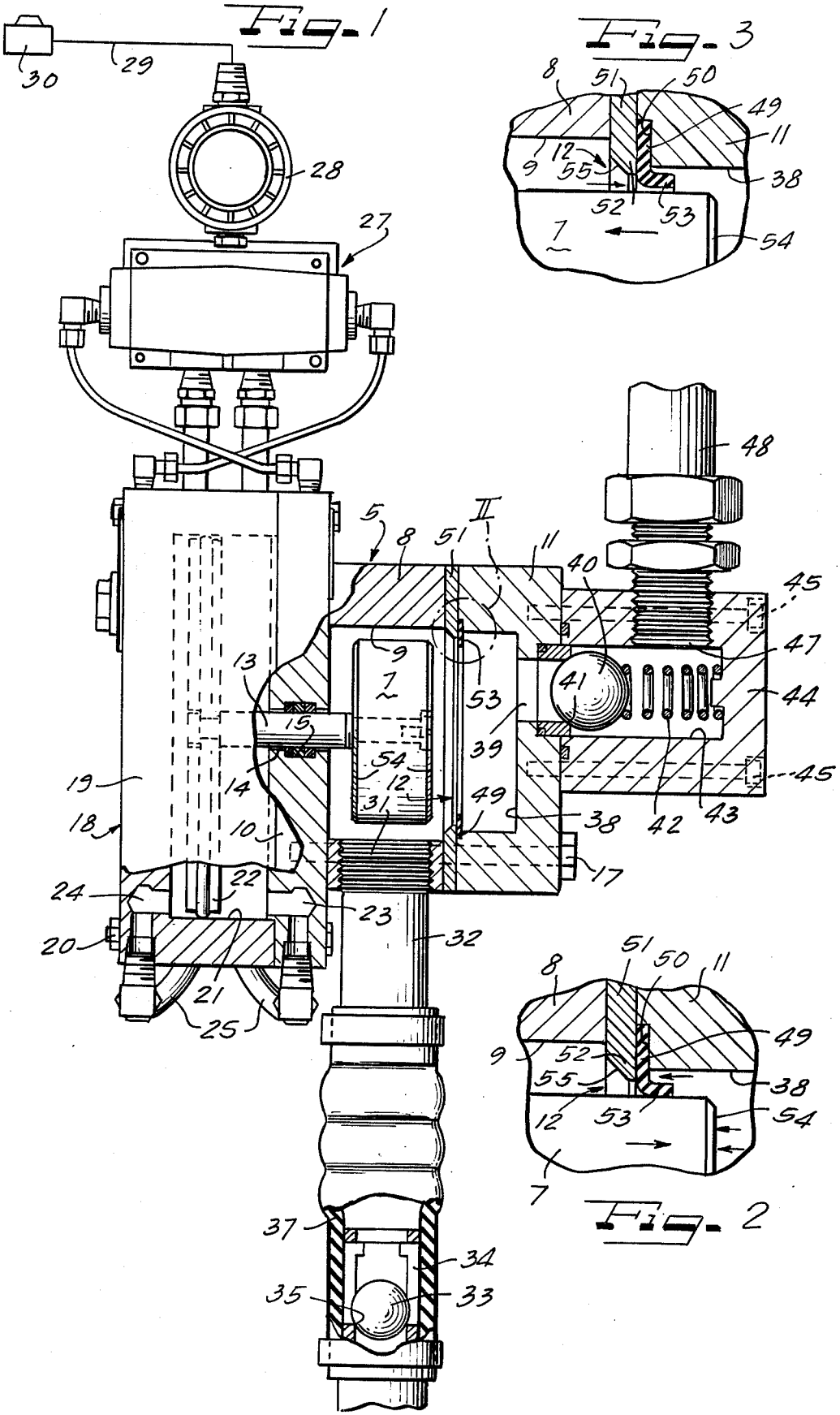
FIG. 1 is an elevational, partially sectional view showing a representative pump embodying features of the invention.
FIG. 2 is an enlarged fragmentary sectional detail view of the encircled area II in FIG. 1 showing action during pumping stroke of the piston.
FIG. 3 is a view similar to FIG. 2 showing action during return stroke of the piston.

By way of example of the best mode contemplated for carrying out the present invention there is shown in FIG. 1 a pump 5 provided with a piston 7 of substantial diameter axially reciprocatable within a hollow cylinder housing member 8 having an axially extending inner wall defining a cylinder chamber 9. The construction and arrangement in this instance is such that pumping flow of material is effected in both forward and return strokes of the piston 7. Excellent pumping efficiency is obtained by combined volumetric and vacuum propulsion of material in each forward and return stroke. Frictional drag between relatively moving parts and wear by abrasion between relatively moving parts is reduced to the barest minimum.

One end of the chamber 9 is closed by an end plate 10. At its other end the chamber 9 has means in the form of a generally cup-shaped end closure member 11 providing a pump discharge or pumping port 12. Support of the piston 7 reciprocatably within the cylinder chamber 9 is effected by means of an axial piston rod 13 which extends through an axial bore 14 in the closure plate 10 equipped with packing means such as a plurality of O-rings 15, the bore 14 being desirably of differentially slightly larger diameter than the piston rod 13 and the O-ring packing effectively supporting the piston rod centered in the bore and avoiding metal-to-metal contact between the piston rod and the wall defining the bore.

For maximum pumping action yield, the piston 7 is not only of substantial diameter but operates in a short stroke. For example, the piston diameter may be about three or more times the length of piston operating stroke. A ratio of about 1½ times cylinder length to piston length is desirable but may vary proportionally. Diameter differential of the piston 7 to the wall of the cylinder chamber 9 is desirably such as to provide adequate spacing between the perimeter of the piston and the cylinder chamber wall to accommodate freely particles of the largest size that may be expected to be entrained in the material being pumped. This provides for complete freedom from wear due to abrasive action of material between the relatively moving perimeter of the piston 7 and the spaced cylinder wall 9. By constructing the piston 7 and the cylinder 8 from suitable material or at least surface treating or hardening the exposed surfaces of the piston and the chamber wall 9 protection against flowing material abrasion, chemicals, acids, alkalies and other potentially damaging factors can be guarded and protected against.

Separable attachment of the cylinder member 8 and the closure member 11 to one another and to the plate 10 may be effected in any desirable manner, but preferably by means of bolts 17 having the shanks thereof extending through suitable bores in the members 8 and 11 and threaded into the end plate 10 which is suitable tapped for this purpose.

Means for reciprocating the piston 7 in pumping strokes may take any preferred form, but preferably comprises a pressure fluid driven motor 18 including a generally cup-shaped cylinder 19 of substantially larger diameter than the cylinder chamber 9 and secured to the plate 10 as by means of bolts 20, whereby the plate 10 provides a closure for the adjacent end of a hollow cylinder chamber 21 within the member 19 and within which is reciprocatably mounted a driving piston 22 secured to the piston rod 13. By having the driving piston 22 of substantially larger diameter than the pump piston 7, a substantial power to driving force ratio advantage is attained from driving pressure fluid delivered through a combination delivery and exhaust port 23 in the motor face of the plate 10 and a similar combination pressure fluid delivery and exhaust port 24 opening through the wall of the cylinder member 19 toward the opposite face of the motor piston 22. Motor actuating pressure fluid is alternately delivered to and exhausted from the motor cylinder chamber 21 through the ports 23 and 24 through respective ducts 25 under the control of a reversing valve 27 to which is connected a regulator 28 through which pneumatic or hydraulic motivating fluid is received by way of a duct 29 from a suitable source 30 such as a pump or compressor.

To facilitate both forward and return stroke pumping by the piston 7 material is supplied through a large flow area inlet port 31 providing a substantially unrestricted passage into the pump chamber 9 for material to be pumped. Material is supplied to the port 31 through a suitable conduit 32 such as a pipe or tube. Although for pumping some materials no check valve may be needed or desired in the inlet passage provided by the port 31 and the conduit 32, it may sometimes be desirable to provide a check valve 33 at a suitable point upstream from the port 31. In a convenient form the check valve 33 may comprise a ball valve member retained in a flow-through cage 34, at the upstream end of which is provided a valve seat 35. In addition pressure booster means may be provided downstream from the valve 33, herein comprising a resiliently flexible storage section 37. Thereby in each pumping stroke of the piston 7 material can readily pass the check valve 33. During any short interval in which there is any tendency for back pressure in the conduit 32, the check valve 33 closes and the resiliently flexible storage chamber 37 expands to accommodate and store the material that may tend to back off for return through the supply conduit, developing a booster pressure which on relief of the back pressure boosts material supply into the pump chamber 9.

In each forward pumping stroke, the piston 7 passes at least during a terminal portion of such forward stroke through the pumping orifice or port 12 into a blind end chamber 38 provided by the closure member 11 and, in effect forming a forward extension of the cylinder working chamber 9. Material pumped into the chamber extension 38 is ejected by pump pressure through an outlet port 39 in the blind end wall of the member 11 and past a check valve 40 which may be in the form of a ball member movable within a limited range from an annular valve seat 41 at the downstream end of the port 39. A biasing spring 42 normally biases the valve member 40 onto the seat 41 within a valve chamber 43 provided by a fixture housing 44 secured as by means of bolts 45 to the member 11. From the chamber 43, material pumped past the valve 40 passes by way of a delivery port 47 to a delivery duct 48.

Pumping action of the piston 7 is substantially improved and enhanced by means comprising a flexibly deflectable elastic lip seal ring 49 cooperating with the piston 7 with combination valving, sealing and wiping effect at least during a terminal portion of the forward stroke of the piston advancing through the pumping orifice or port 12. For this purpose, the ring 49, formed from a suitable elastomeric material is of a flat form and of an outside diameter larger than the diameter of the piston 7 so as to be received in a complementary seating groove 50 provided in the inner face of the member 11 about the port 12. Retaining means in the form of a rigid ring plate 51 at the upstream side of the ring 49 clamps the ring 49 in the groove 50, the ring 49 thereby serving as a static seal for the joint between the plate 51 and the member 11, at the high pressure side of the pump. In a desirable form, the clamping ring 51 has an outside diameter about the same as the cylinder member 8 and is clamped as a gasket between the members 8 and 11. At its inner diameter, the clamping ring plate 51 provides, in effect, an annular rib 52, defining the port 12, and which rib is of substantially smaller inside diameter than the cylinder chamber wall 9 but is of slightly larger inside diameter than the piston perimeter so that the piston 7 can move freely through the discharge port 12.

For its valving, sealing and wiping function in cooperation with the piston 7, the ring 49 is of substantially smaller inside diameter than the diameter of the piston. In a typical relationship, the inside diameter of the ring 49 may be about 3/16 of an inch (5mm) smaller than the diameter of the piston 7 so that when the piston drives through the ring 49 in forward stroke, the annular portion of the ring which projects radially inwardly beyond the edge of the rib 52 provides a seal across the gap between the piston 7 and the surrounding structure. By reason of its fixed mounting in the path of the stroking movement of the piston, the inwardly projecting portion of the ring 49 is stretched and deflected to project as a lip 53 in the direction of forward pumping stroke of the piston. Thereby, the lip 53 engages the piston perimeter with sealing, wiping, effect (FIG. 2). As the piston 7 advances through the ring 49, and more particularly the lip 53, pump pressure generated by the piston in the chamber 38 reacts, as generally indicated by directional arrows, to compress the lip 53 toward the piston perimeter, thereby improving the sealing grip of the lip on the piston perimeter. This reaction is enhanced by having the diameter of the chamber 38 at least in the area thereof surrounding the lip 53 at least slightly larger than the outside diameter of the lip.

To facilitate safe engagement of the ring 49 by the piston 7, and smooth expansion advance of the piston into the lip 53, the advancing edge of the piston is desirably provided with an annular camming surface such as a chamfer 54 which may be on an angle of about 45° to the face of the piston. As shown, both ends of the piston 7 may be provided with the chamfer 54 where the piston is reversibly mounted on the piston rod 13. Movement of pumped material past the rib 52 is desirably enhanced by providing the upstream side of the rib with a leadout flow easing surface such as a chamfer 55.

As best seen in FIG. 2, the elastic ring lip 53 provides the only surface in the pump with which the perimeter of the piston 7 engages at any time. All other surfaces within the pump remain at all times spaced from the perimeter of the piston 7, and in particular throughout the forward and return pumping stroke range of the piston.

In return stroke, the piston produces a suction effect in the extension chamber 38, closing the valve 40 and developing a negative pressure or vacuum in the chamber 38. This virtually instantaneously on reversing of the piston 7, relieves the compressive force on the sealing lip 53 and by reason of the clearance about the lip in the chamber 38 permits the lip to expand by reason of pressure from within the chamber 9, as indicated by directional arrows in FIG. 3, whereby the sealing grip of the lip 53 is relieved from the piston perimeter, and substantially diminishes the power load that would otherwise be consumed in drawing the piston in reverse through the tensioned lip. Such expansion relief effect on the lip 53 progresses as the vacuum in front of the piston increases and the return pumping pressure within the chamber 9 generated by the returning piston increases. As the piston 7 leaves the lip 53, free forward movement of material from the chamber 9 into the chamber 38 occurs preparatory to a repetition of the pumping cycle. During stroking of the piston 7, the rib 52 by virtue of its relatively close but free adjacent relation to the piston perimeter and contiguity to the sealing ring 49, serves as a backup for the lip 53 and its juncture with the fixedly secured body of the sealing ring and prevents extrusion thereof past the rib portion 52.

It will thus be apparent that efficient pumping can be accomplished with advance of material through the pump in both forward and return strokes of the piston 7, with only the downstream check valve 40 although the upstream check valve 33 may also be used, and without requiring any check valve in the piston itself, although it will be apparent that the seal lip 53 provides a check valve in engagement with the forwardly advancing piston to prevent blowback of material from the pump chamber 38. Desirably the port 31 is at least as large in cross sectional flow area as the outlet ports 39 and 47, and preferably of larger cross sectional flow area so as to promote maximum pumping efficiency. A quite versatile pump is provided which may be produced in small lightweight unit size for pumping low viscosity fluids such as water, and particularly fluids that may contain solid contaminants; but the pump is exceptionally capable in more rugged construction to move heavy, for example high viscosity fluid materials and abrasive materials, with very little wear factor. In pumping action of the piston 7 it is wiped clean by the only part that it contacts, namely the combination valving, sealing and wiping ring 49. Therefore the pump is tolerant of particulate matter of substantial size in the material stream. Such particulate material may or may not be abrasive. Abrasive materials are easily and efficiently handled and do not present problems insofar as the pumping piston or cylinder are concerned. Maximum pumping yield from the power input is attained. Because of the unique construction of the pump, it can even run dry indefinitely without overheating or other deterioration. The only part that may become worn from prolonged use, the ring 49 can be easily and quickly replaced by simply removing the bolts and opening the pump for ready access to that part.

It will be understood that variations and modifications may be effected without departing from the spirit and scope of the novel concepts of this invention.

I claim as my invention:

1. A pump for fluent materials and especially suitable for moving heavy fluent and abrasive materials, comprising:

a housing member providing a hollow cylinder chamber receptive of material to be pumped and having an axially extending chamber wall and opposite ends;

a piston within and shorter than the cylinder chamber and having its perimeter of smaller diameter than and in limited spaced gap relation to said wall so that material can flow through the gap;

a closure at one end of the cylinder chamber and means for guiding a piston rod of the piston for axial forward and return strokes of the piston relative to the opposite end of the cylinder chamber;

means for driving the piston rod and thereby the piston in said forward and return strokes;

a closure member and means securing the closure member to said housing member in closing relation to said opposite end of the cylinder chamber, and said closure member having a blind end chamber which forms a forward extension from the cylinder chamber and into which the piston extends a limited distance in the forward stroke of the piston, said blind end extension chamber being of a diameter which is larger than the diameter of the piston perimeter so that there is a limited spaced gap relation between the piston perimeter and said extension chamber when the piston extends into said extension chamber;

means for introducing into said cylinder chamber material to be pumped, and check valved means for receiving pumped material from said extension chamber;

a rigid annular ring plate clamped between said housing member and said closure member and having an inner annular rib portion which extends to a smaller diameter than the diameters of the cylinder chamber wall and the extension chamber wall but to a larger diameter than the piston perimeter diameter, said rib portion defining a port through which the piston moves freely in a forward stroke from a position wherein the forward end of the piston is entirely within the cylinder chamber and clear of said rib portion; and a combination valving, sealing and wiping elastic ring comprising a normally substantially flat elastic annular element fixedly clamped between said ring plate and said closure member and having an annular portion projecting radially inwardly beyond said rib portion to a substantially smaller diameter than the diameter of the piston perimeter, said elastic ring being engaged by the piston during the forward stroke through said rib portion and the piston elastically expanding the radially inwardly projecting portion of the elastic element into a tensioned sealing and wiping annular lip extending forwardly on the piston perimeter and maintaining pumping pressure in said blind end chamber against leakage past said rib flange during said forward stroke of the piston;

said rib portion serving as a backup for the elastic ring to prevent backward extrusion of the ring past the rib portion due to pumping pressure in said blind end chamber;

said piston producing a suction effect and developing a negative pressure in said extension chamber during the return stroke of the piston whereby said lip expands and relieves its grip on the piston perimeter and diminishes the power load required to withdraw the piston from the lip during the return stroke;

said piston completely withdrawing from the elastic ring in said return stroke so that material can flow from said cylindr chamber past said piston and through said rib portion and said elastic ring into said blind end chamber in response to said negative pressure;

said lip providing the only surface in the pump with which the perimeter of the piston engages at any time and all other surfaces within the pump remaining at all times spaced from the piston perimeter.

2. A pump according to claim 1, wherein said rib portion has an oblique annular lead-out surface on its cylinder chamber side to facilitate movement of material from the cylinder chamber past said rib portion into said extension chamber.

3. A pump according to claim 1, wherein the diameter of said extension chamber wall is larger than the outside diameter of said annular lip portion when the lip portion is in tensioned gripping engagement with the piston perimeter, so that there is a gap between the lip portion and said extension chamber wall and the lip portion is exposed to piston generated pumping pressure in said extension chamber during the forward stroke of the piston through said elastic ring.

4. A pump according to claim 1, including a valveless material inlet of substantial cross-sectional flow area into said cylinder chamber, means for supplying material to the cylinder chamber through said inlet including a pressure booster comprising a resiliently flexible expansile tubular section in a duct leading to said inlet, and a check valve upstream of said pressure booster preventing return flow from the booster during return strokes of the piston.

* * * * *